US006892956B2

(12) United States Patent
Yildirim et al.

(10) Patent No.: US 6,892,956 B2
(45) Date of Patent: May 17, 2005

(54) FUEL INJECTION VALVE

(75) Inventors: Fevzi Yildirim, Gerlingen (DE); Guenther Hohl, Stuttgart (DE); Michael Huebel, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/467,039

(22) PCT Filed: Nov. 25, 2002

(86) PCT No.: PCT/DE02/04317

§ 371 (c)(1),
(2), (4) Date: Jan. 6, 2004

(87) PCT Pub. No.: WO03/054382

PCT Pub. Date: Jul. 3, 2003

(65) Prior Publication Data

US 2004/0124274 A1 Jul. 1, 2004

(30) Foreign Application Priority Data

Dec. 5, 2001 (DE) ..... 101 59 750

(51) Int. Cl.[7] ..... B05B 3/04
(52) U.S. Cl. ..... 239/102.2; 251/129.06
(58) Field of Search ..... 239/102.2; 251/129.06, 251/282, 335.3, 337

(56) References Cited

U.S. PATENT DOCUMENTS 6,311,950 B1 * 11/2001 Kappel et al. ..... 251/129.06

FOREIGN PATENT DOCUMENTS

| | | |
|---|---|---|
| DE | 195 34 445 | 9/1995 |
| DE | 100 07 733 | 8/2001 |
| DE | 10007735 | 9/2001 |
| EP | 1 046 809 | 10/2000 |
| EP | 1 111 230 | 6/2001 |

* cited by examiner

*Primary Examiner*—David A. Scherbel
*Assistant Examiner*—Thach H. Bui
(74) *Attorney, Agent, or Firm*—Kenyon & Kenyon

(57) ABSTRACT

A fuel injector for the direct injection of fuel into the combustion chamber of an internal combustion engine encompasses a piezoelectric or magnetostrictive actuator, a valve needle actuable by the actuator, the valve needle cooperating with a valve-closure member to form a sealing seat together with a valve-seat member, and a restoring spring by which the valve needle is acted on in a closing direction. The valve needle is pressure-equalized in that the force exerted by the fuel pressure on the valve needle in the opening direction is approximately equal to the force exerted by the fuel pressure on the valve needle in the closing direction.

9 Claims, 1 Drawing Sheet

FUEL INJECTION VALVE

FIELD OF THE INVENTION

The present invention is directed to a fuel injector of the type set forth in the main claim.

BACKGROUND INFORMATION

German Patent No. 195 34 445 C2 discusses a fuel injector which has a nozzle needle that is axially movable in a nozzle body. The nozzle needle can be actuated by a piezoelectric actuator and is held in the closed position by a compression spring. Fuel is supplied by an external source at a freely adjustable pressure. The nozzle needle has a central bore and the actuator concentrically surrounds the nozzle needle and is sealed from the fuel pressure with the aid of sealing surfaces.

A particular disadvantage of the fuel injector from German Patent No. 195 34 445 is that, the sealing surfaces notwithstanding, the lift of the actuator may vary because of the effect of the fuel pressure, to such an extent that an air gap, which is provided between the actuator and the valve needle to compensate for thermal linear deformations, becomes so large that the valve cannot be opened.

SUMMARY OF THE INVENTION

In contrast, the fuel injector according to the present invention, has the advantage over the related art that the constructive design of the valve needle allows the actuator to be relieved by pressure-equalization of the valve needle. In the closed state of the fuel injector, the valve needle is not subjected to a pressure force component in the axial direction, thereby relieving the actuator.

The valve needle may be freed of forces in that the valve needle is in connection with a flexible seal and the junction with the flexible seal has the same radial distance from the center axis of the fuel injector as the sealing seat.

A throttle gap, which intercepts the dynamic portion of the pressure, may be formed between the valve needle and a valve-needle guide. In this way, compressive oscillations no longer reach the corrugated-tube seal.

A restrictor, formed between an annular valve-needle guide and the housing of the fuel injector, ensures that compressive oscillations caused by the fuel flowing through the fuel injector cannot be transmitted to the valve needle. In this way, the actuator is also free of mechanical pressure loads by the fuel.

Furthermore, the inner diameter of the valve-needle guide may correspond to the inner diameter of the sealing seat, so that the valve needle and the actuating body, which may be in operative connection thereto, are axially guided, thereby avoiding offsets of the valve needle and the actuating body.

DETAILED DESCRIPTION

Figure 1:
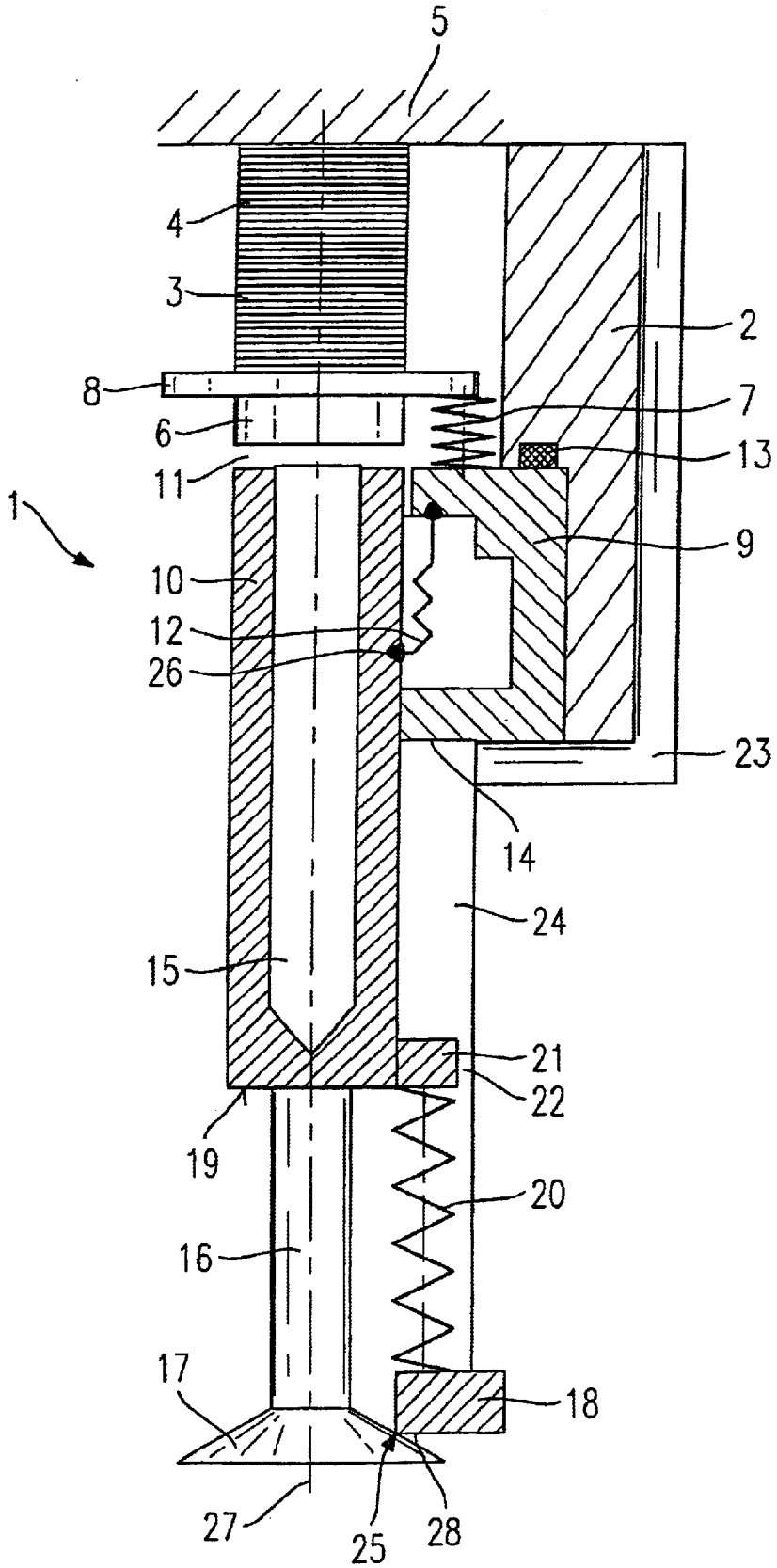
FIG. 1 shows a section through an exemplary embodiment of a fuel injector of the present invention.

A first exemplary embodiment of a fuel injector 1, shown in FIG. 1, is designed in the form of a fuel injector 1 for fuel-injection systems of mixture-compressing internal combustion engines having externally supplied ignition. Fuel injector 1 may be used for the direct injection of fuel into a combustion chamber (not shown) of an internal combustion engine.

Fuel injector 1 includes a housing 2 in which an actuator 3 is arranged. Actuator 3 is made up of a plurality of layers 4, for instance, which are made of a piezoelectrically excitable material and may be joined to each other, for example by bonding. On the inflow side, actuator 3 is braced on a housing component 5 and, on the downstream side, on an actuator head 6. A compression spring 7, which is supported on one side on a shoulder 8 of actuator head 6 and on the other side on an intermediate component 9, prestresses actuator 3.

On the downstream side of actuator head 6 is a valve needle 10, an air gap 11 being formed between actuator head 6 and valve needle 10. Valve needle 10 penetrates intermediate component 9. Valve needle 10 with intermediate component 9 is sealed from the fuel flowing through fuel injector 1 by a flexible seal 12, preferably a flexible corrugated-tube seal 12. Corrugated-tube seal 12 is in each case welded to intermediate component 9 and valve needle 10. Housing 2 and intermediate component 9 are sealed from one another by a sealing ring 13.

Valve needle 10 penetrates intermediate component 9, which has a U-shaped cross section, for example, in such a way that a side piece 14 on the downstream side of intermediate component 9 is used as valve-needle guide. Valve needle 10 may have a recess 15, for reasons of better switching dynamics, for example.

Disposed on the downstream side of valve needle 10 is an actuating body 16, which includes a valve-closure member 17 at its downstream-side end. Valve-closure member 17 cooperates with a valve-Beat surface 28 to form a sealing seat 25. Valve-seat surface 28 may, in particular, be formed on a ring-shaped valve-seat member 18, which is either integrally designed with housing 2 or connected thereto in some suitable manner. Arranged between valve-seat member 18 and a downstream-side end 19 of valve needle 10 is a restoring spring 20, which holds fuel injector 1 closed in the non-energized state of actuator 3.

Furthermore, fuel injector 1 includes a valve-needle guide 21, which may have an annular design, for instance, and whose radial extension is selected such that a restrictor 22 is formed between ring-shaped valve-needle guide 21 and housing 2.

The fuel flowing through fuel injector 1 is supplied via a fuel supply (not shown further) and carried past actuator 3 by way of a fuel line 23, which runs in housing 2, for instance. On the downstream side of corrugated tube 12 is an inner chamber 24 of fuel injector 1, which is completely filled with fuel. This fuel is under fuel pressure, the so-called system pressure. Since the fuel can pass restrictor 22 only in a throttled manner and, thus, under a considerably lower pressure, it is achieved, on the one hand, that compressional oscillations are unable to reach corrugated tube 12, and actuator 3 therefore remains unaffected by compressional oscillations and, on the other hand, that the mechanical stress of valve needle 10 and of actuating member 16 by the fuel pressure remains low, thereby making it impossible for compressional vibrations to generate resonant vibrations.

If an electric voltage is supplied to actuator 3 via an electric line (not shown further), piezoelectric layers 4 expand, so that actuator base 6 moves in the direction of valve needle 10 in a discharge direction of the fuel, thereby closing air gap 11 between actuator base 6 and valve needle 10. During further expansion of piezoelectric layers 4, actuator 3 presses valve needle 10, and thus actuating member 16 as well, in the discharge direction of the fuel, so that valve-closure member 17 formed on actuating member

16 lifts off from valve-seat surface 28 formed on valve-seat member 18, fuel injector 1 is opened and fuel is spray-discharged into the combustion chamber (not shown further) of the internal combustion engine.

If the voltage energizing piezoelectric actuator 3 is switched off, piezoelectric layers 4 contract. This causes actuator base 6 to lift off from valve needle 10, thereby relieving valve needle 10. Restoring spring 20 presses valve needle 10 back into its original position, counter to the discharge direction of the fuel, thereby returning actuating member 16 and valve-closure member 17 formed thereon to their original position as well. Fuel injector 1 is closed.

If junction 26, at which valve needle 10 is joined to flexible seal 12, such as corrugated-tube seal 12, has the same radial clearance as sealing seat 25 from center axis 27 of fuel injector 1, valve needle 10, in the closed state, is not acted on by the fuel pressure and is pressure-equalized. Thus, even when air gap 11 is closed, no forces are transmitted to actuator 3 by valve needle 10.

The present invention is not restricted to the exemplary embodiment shown, but also applicable, for instance, to inwardly opening fuel injectors 1 or magnetostrictive actuators 3.

What is claimed is:

1. A fuel injector for directly injecting fuel into a combustion chamber of an internal combustion engine, comprising:

one of a piezoelectric actuator and a magnetostrictive actuator;

a valve needle actuatable by the actuator; and a restoring spring by which the valve needle is acted on in a closing direction;

wherein the valve needle cooperates with a valve-closure member and forms a sealing seat together with a valve-seat body, and the valve needle is pressure-equalized in that a force exerted by fuel pressure on the valve needle in the opening direction is approximately equal to a force that the fuel pressure exerts on the valve needle in the closing direction;

wherein the actuator is prestressed by a compression spring.

2. The fuel injector of claim 1, wherein the valve needle is connected to a flexible seal at a junction that has the same radial clearance from a center axis of the fuel injector as the sealing seat.

3. The fuel injector of claim 1, further comprising:

a valve-needle guide which forms a restrictor together with a housing of the fuel injector.

4. The fuel injector of claim 3, wherein an inner diameter of the valve-needle guide is equal to an inner diameter of the valve-seat body.

5. The fuel injector of claim 3, wherein the valve needle penetrates an intermediate component arranged in the housing of the fuel injector.

6. A fuel injector for directly injecting fuel into a combustion chamber of an internal combustion engine, comprising:

one of a piezoelectric actuator and a magnetostrictive actuator;

a valve needle actuatable by the actuator; and a restoring spring by which the valve needle is acted on in a closing direction;

wherein the valve needle cooperates with a valve-closure member and forms a sealing seat together with a valve-seat body, and the valve needle is pressure-equalized in that a force exerted by fuel pressure on the valve needle in the opening direction is approximately equal to a force that the fuel pressure exerts on the valve needle in the closing direction; and wherein the intermediate component is sealed from the housing of the fuel injector by a sealing ring.

7. The fuel injector of claim 5, wherein the valve needle and the intermediate component are sealed from fuel flowing through the fuel injector by a corrugated-tube seal.

8. The fuel injector of claim 7, wherein the corrugated-tube seal is welded to the valve needle and the intermediate component.

9. The fuel injector of claim 1, wherein an air gap is formed between a base of the actuator and the valve needle.

* * * * *

UNITED STATES PATENT AND TRADEMARK OFFICE

CERTIFICATE OF CORRECTION

PATENT NO. : 6,892,956 B2
DATED : May 17, 2005
INVENTOR(S) : Fevzi Yildirim et al.

It is certified that error appears in the above-identified patent and that said Letters Patent is hereby corrected as shown below:

Column 2,
Line 30, change “a valve-Beat surface” to -- a valve-seat surface --.

Signed and Sealed this

Twenty-third Day of August, 2005

JON W. DUDAS
*Director of the United States Patent and Trademark Office*